United States Patent [19]

Gilb

[11] 4,050,210

[45] Sept. 27, 1977

[54] RIDGE CONNECTOR FOR LIGHT COMPOSITE TRUSSES

[75] Inventor: Tyrell Gilb, Berkeley, Calif.

[73] Assignee: Simpson Manufacturing Co., Inc., San Leandro, Calif.

[21] Appl. No.: 770,700

[22] Filed: Feb. 22, 1977

[51] Int. Cl.[2] ..... E04C 3/02; E04C 5/18

[52] U.S. Cl. ..... 52/639; 52/693; 403/217

[58] Field of Search ..... 403/217; 52/692, 694, 52/639-641, 693

[56] References Cited

U.S. PATENT DOCUMENTS

| | | | |
|---|---|---|---|
| 3,137,899 | 6/1964 | Troutner | 52/693 |
| 3,330,087 | 7/1967 | Troutner | 52/693 |
| 3,535,845 | 10/1970 | Troutner | 52/639 |
| 3,537,224 | 11/1970 | Troutner | 403/217 |
| 3,646,725 | 3/1972 | Troutner | 52/693 |
| 3,857,218 | 12/1974 | Gilb | 52/694 |
| 3,946,532 | 3/1976 | Gilb | 52/692 |
| 3,961,455 | 6/1976 | Peters | 52/693 |
| 3,985,459 | 10/1976 | Gilb | 403/217 |

*Primary Examiner*—James L. Ridgill, Jr.
*Attorney, Agent, or Firm*—James R. Cypher

[57] ABSTRACT

The connector elements consist of a pair of identical essentially U-shaped channels with integral flaps providing a compression plate between the lumber end butts and depending legs formed with openings for receiving pins or bolts for attachment to the truss tubular webs.

5 Claims, 14 Drawing Figures

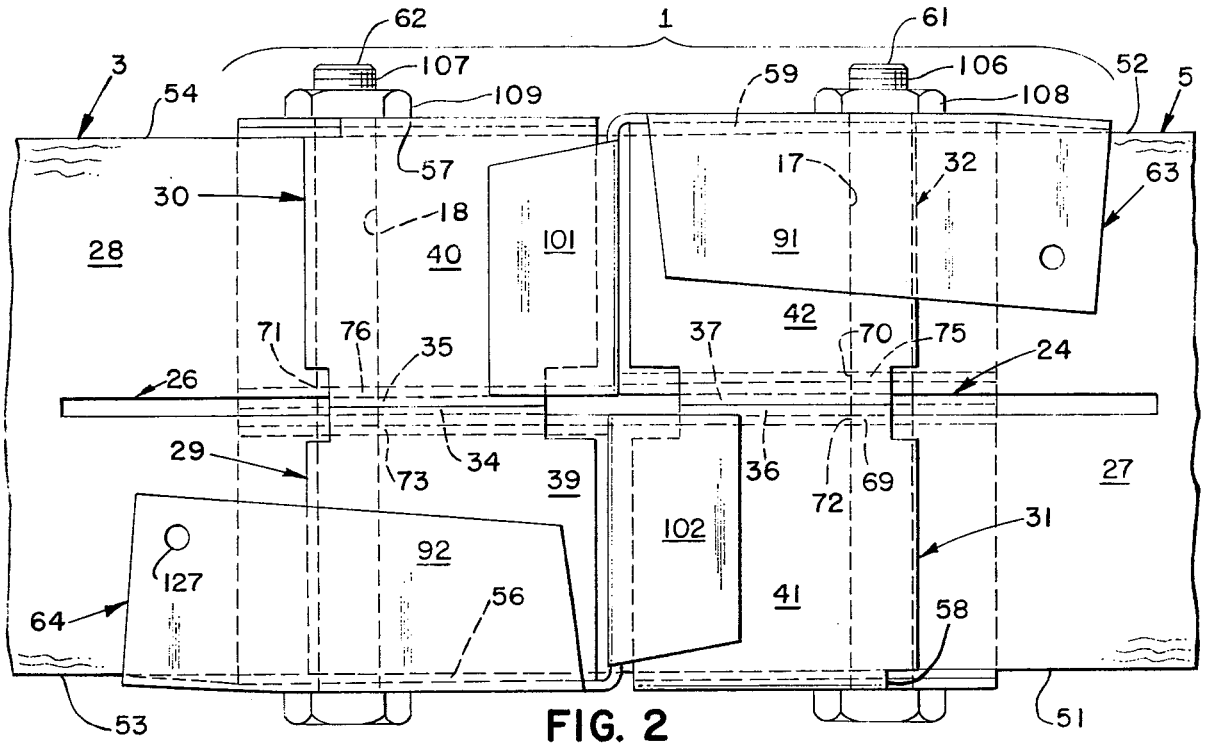
FIG. 2
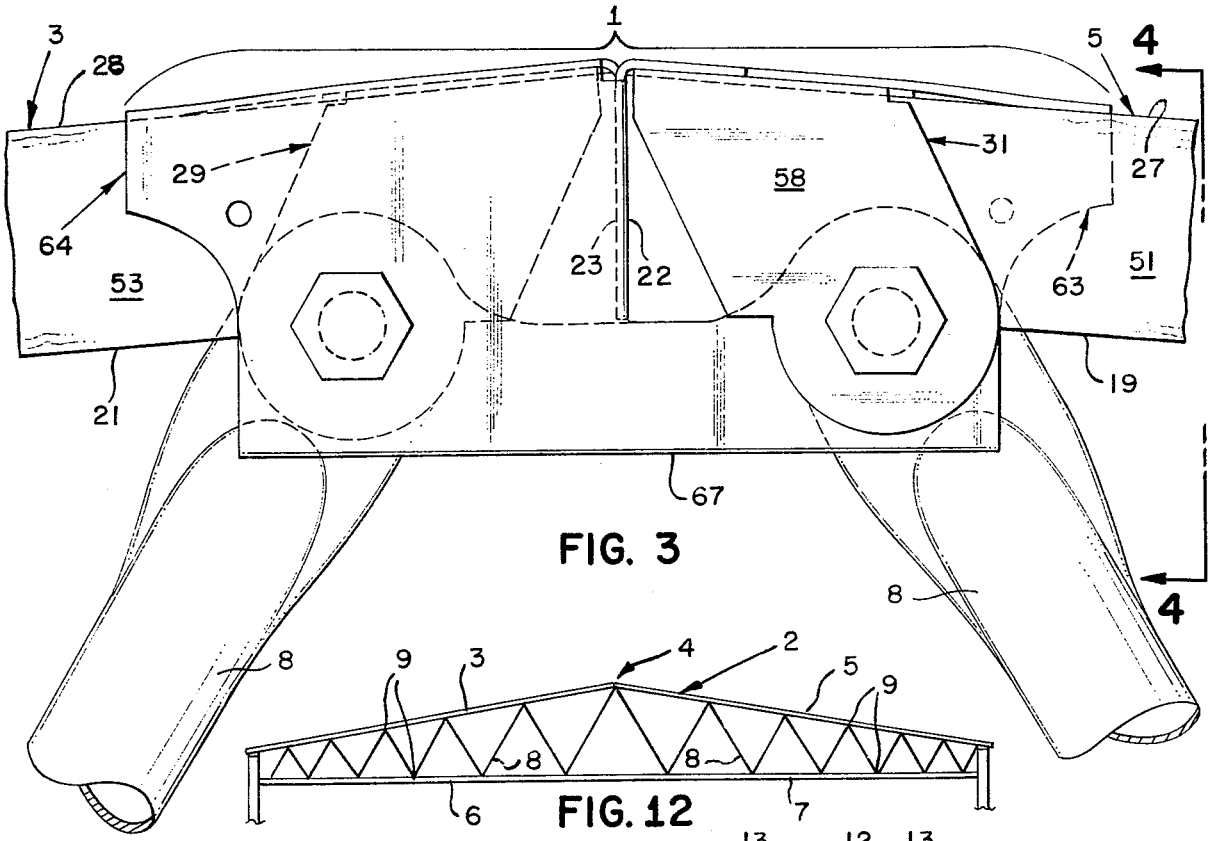
FIG. 3
FIG. 12
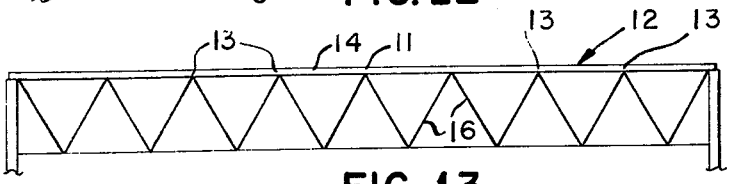
FIG. 13

RIDGE CONNECTOR FOR LIGHT COMPOSITE TRUSSES

BACKGROUND OF THE INVENTION

Composite trusses constructed from lumber top chords and metal webs have seen wide commercial usage in the western United States for the past 18 years. Heavy duty composite trusses consist of a pair of lumber members forming the top chords and light duty trusses are characterized by a single 2 × 4 or 2 × 6 lumber member forming the top chord. Examples of heavy duty trusses are set forth in Gilb, U.S. Pat. No. 3,946,532 and Troutner U.S. Pat. No. 3,330,087. Examples of light duty trusses are set forth in Gilb U.S. Pat. No. 3,857,218, Peters U.S. Pat. No. 3,961,455 and Troutner U.S. Pat. No. 3,137,899.

All of the above patents relate to flat trusses yet a significant percentage of designs call for pitched trusses. Ridge connectors for the heavy duty trusses are set forth in Gilb U.S. Pat. No. 3,985,459 and Troutner U.S. Pat. No. 3,646,725 but none of the patents teach or suggest a solution for a ridge connector for light trusses having pitched upper wood chords.

SUMMARY OF THE DISCLOSURE

The gist of the present invention is the use of a pair of identical U-shaped metal members formed from sheet metal in combination with two pairs of grip groove sheet metal connectors as described in Gilb U.S. Pat. No. 3,857,218 to connect the butt ends of the pitched top chord lumber members to the metal webs of a light truss.

The principal object is to provide a ridge joint for light trusses which produces the maximum load value with the lowest cost metal connectors.

Another object is to provide a ridge connector which eliminates the need for special cast metal connectors.

A further object is to provide a connector which uses similar assembly technology and similar elements as are used in the other joints of trusses constructed in accordance with Gilb patent U.S. Pat. No. 3,857,218.

Still another object is to provide a connector which permits the wood chord members to abutt one another except for a single sheet metal member.

The function of the present connector is to:

1. Connect the two ends of the top wood chord together and to hold them in the same relationship; resisting tension loads, lateral forces and shearing forces;
2. Provide end bearing for the high compressive forces exerted by the abutting ends against one another;
3. Provide a means for connecting at least two metal web members at the joint; and
4. Provide a connector which is easily installed and will accommodate chord pitches from flat to a slope by simple field modification.

BRIEF DESCRIPTION OF THE DRAWINGS

FIG. 2 is a top plan view of the connector illustrated in FIG. 1.

FIG. 3 is a side view of the connector as shown in FIGS. 1 and 2.

FIG. 12 is a side view of a pitched Warren truss on a greatly reduced scale illustrating one use of the connector of the present invention.

FIG. 13 is a side view of a flat Warren truss on a greatly reduced scale illustrating another possible use of the connector; namely spliced connections.

DESCRIPTION OF THE PREFERRED EMBODIMENTS

Figure 1:
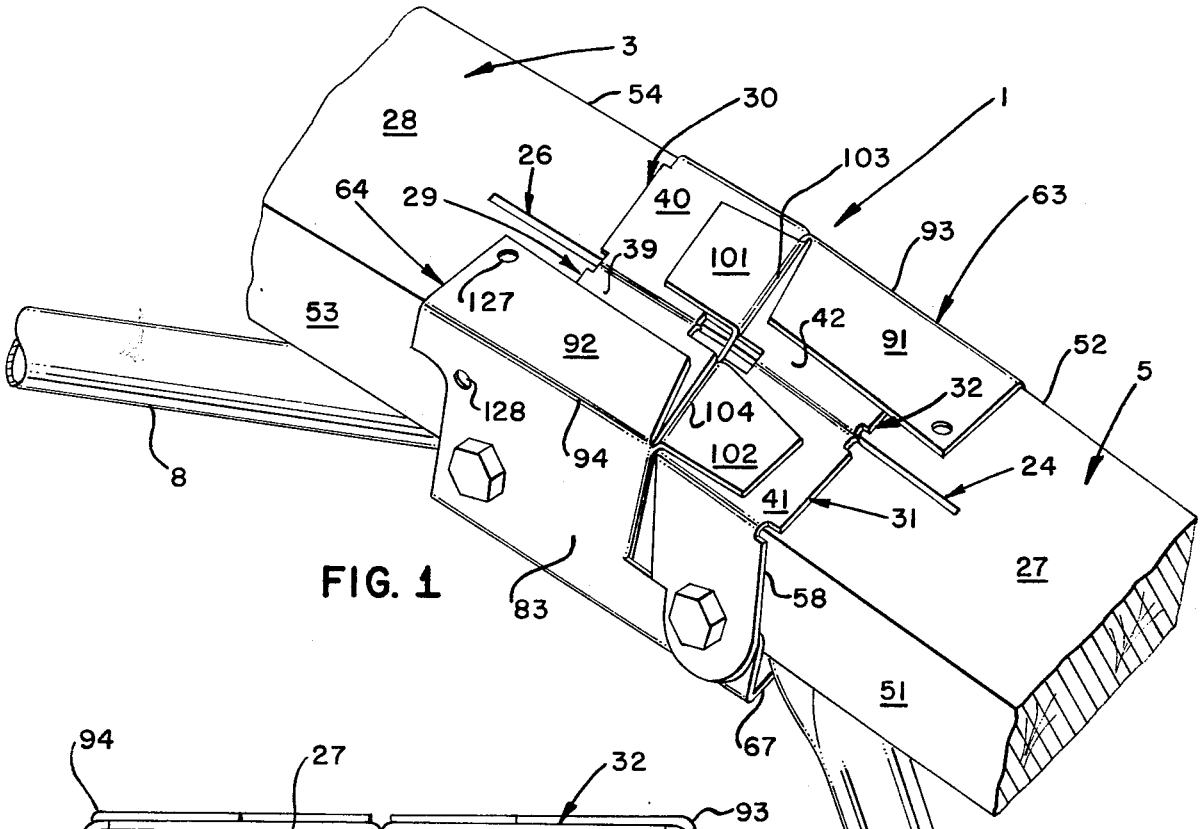
FIG. 1 is a perspective view of a connector of the present invention with portions of the abutting ends of the top wood chord and portions of the connecting metal webs.
Figure 4:
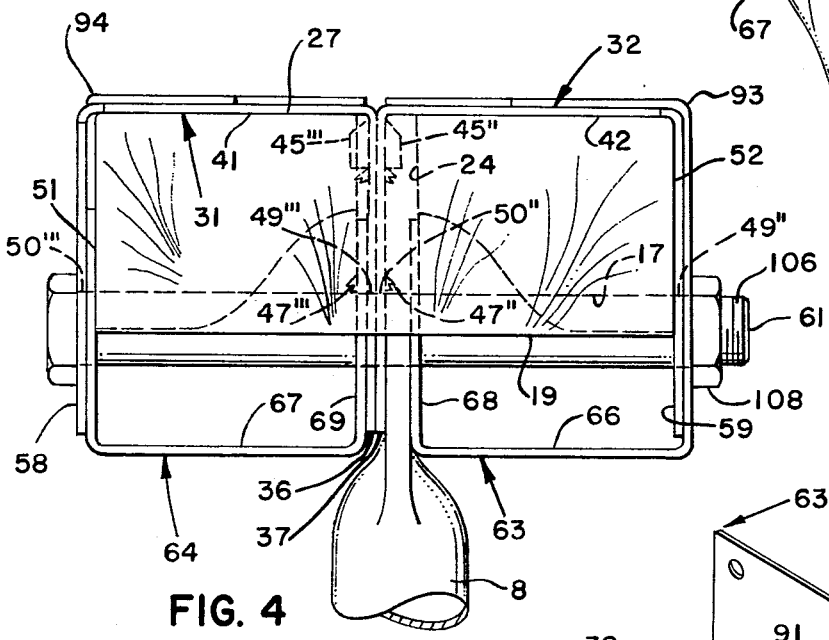
FIG. 4 is an end view taken generally along line 4—4 of FIG. 3.
Figure 14:
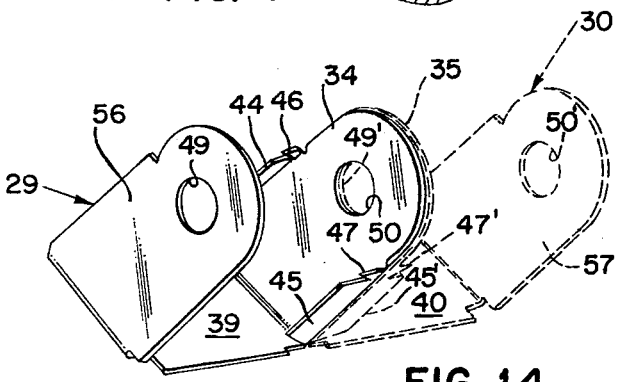
FIG. 14 PRIOR ART
FIG. 14 is a perspective view of the grip-groove connector as fully described in Gilb U.S. Pat. No. 3,857,218.
Figure 11:
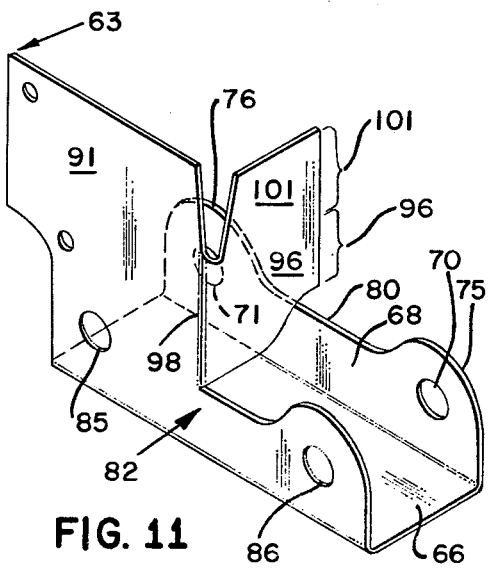
FIG. 11 is a perspective view of the other ridge connector used in the ridge joint and is identical to the first ridge connector illustrated in FIGS. 5-10.

The ridge connector shown in FIG. 1 and generally designated by the number 1 may be used with a light pitched truss 2 as shown in FIG. 12. The truss is formed with a single flat lumber member 3 such as a 2 × 4 on one side of the ridge 4 and a single flat lumber member 5 such as a 2 × 4 on the other side of the ridge. The ridge connector 1 connects the two top chords at the ridge joint 4. The top chord members are connected to the bottom chord members 6 and 7 by metal web members 8. The joint connections at all joints, other than at the ridge joint and generally indicated by the number 9 may be accomplished by pins as shown in Troutner U.S. Pat. No. 3,137,899 or preferably by edge pin connectors as shown in Gilb U.S. Pat. No. 3,857,218.

A unique feature of the ridge connector of the present invention is the fact that it may also be used at a mid joint 11 of a flat truss 12 as shown in FIG. 13 or at any other top chord joint 13 where a splice in the top chord 14 occurs. The truss in FIG. 13 is assembled in the same manner as the truss in FIG. 12 with metal webe 16, and the wood top and bottom chords are connected at all joints 13 other than the mid joint or splice joints in the top chords with pins or edge pin connectors as set forth above.

Referring specifically to the ridge joint, the wood chords are prepared by forming a transverse semi-circular groove 17 and 18 across their inside faces 19 and 21 adjacent the abutting ends 22 and 23. Slots 24 and 26 joining the inner faces 19 and 21 and outer faces 27 and 28 at the approximate center lines are formed in the chords adjacent the butt ends.

A pair of U-shaped grip groove connectors as shown in FIGS. 1, 2, 3, 4 and 14 and identical to the connectors described in Gilb U.S. Pat. No. 3,857,218 are mounted on each end of the chords. The grip groove connectors are indicated by the numbers 29, 30, 31, and 32. Each grip-groove connector is formed with an inner leg as indicated by the numbers 34, 35, 36 and 37 and an outer leg as indicated by number 56, 57, 58 and 59 extending from bases 39, 40, 41 and 42. The inner leg of each grip-groove connector is formed with flanges 44, 45, 44'

(not shown) and 45' and preferably with a sharp saw tooth 46 and 47, 46' (not shown) and 47' preceeding the flange. The inner legs of grip groove connectors 31 and 32 in like manner are formed with flanges 44' and 44''' (not shown) 45'' and 45''' and a saw tooth 46'' and 46''' (not shown) and 47'' and 47'''. Each leg is formed with an opening 49, 49', 50 and 50' dimensioned for insertion of a pin or bolt. Grip groove connectors 31 and 32 are also formed with openings 49'', 49''', 50'' and 50'''. The grip groove connectors are mounted on the wood chord by inserting the inside legs into the slot and the outside leg engages the outside edges 51, 52, 53 and 54 of the chord. Referring to FIGS. 1, 2, 3, 4 and 14, grip groove connector 29 is mounted by inserting inner leg 34 into slot 26 with outside leg 56 engaging face 53 of the chord. Grip groove connector 30 is mounted by inserting leg 35 into slot 26 with outside leg 57 engaging face 54 of chord 3. Grip groove connectors 31 and 32 are mounted on the other chord 5 with inside legs 36 and 37 inserted into groove 24 and outside legs 58 and 59 engage outside chord edges 51 and 52 respectfully. The grip-groove connector openings are in alignment for the receipt of pins or bolts 61 and 62.

In addition to the grip groove connectors at the ridge or splice connection are a pair of identical U-shaped ridge connectors 63 and 64 which connect the abutting ends 22 and 23 of the chords. Each ridge connector includes an elongated base 66 and 67 and each is formed with a first leg 68 and 69 extending at right angles from their respective bases. Openings 70 and 71 are formed in connector 63 and openings 72 and 73 are formed in first leg 69 of connector 64. Preferably, the edges 75, 76, 77 and 78 around each of the openings are curved as shown in the drawings with generally straight edges 80 and 81 formed between the curved portions. The first legs 68 and 69 are adapted for insertion into slots 24 and 26.

Each of the ridge connectors is formed with second legs 82 and 83 which are formed with openings 85, 86, 88 and 89 which are positioned in alignment with the openings in the first legs. Each of the second legs is formed with first extensions 91 and 92 which are adapted for engaging the edges 52 and 53 and a portion of the outer faces 27 and 28 of the chords. Each extension is bent along a line 93 and 94. The second legs are also formed with second extensions 96 and 97 for engaging the faces of the butt ends 22 and 23 of the chords. The second extensions are bend along lines 98 and 99. Third extensions 101 and 102 are connected to the second extensions along fold lines 103 and 104 and engage the bases 40 and 41 of the grip-groove connectors 30 and 31.

After mounting the grip groove connectors and the ridge connectors on the chords, bolts 61 and 62 with threaded ends 106 and 107 for receipt of nuts 108 and 109 are inserted through the openings in the grip groove and ridge connectors. The bolts engage the edges of the semi-circular grooves 17 and 18.

As shown in the illustrations, the U-shaped ridge connectors are identical, not mirror images, and are mounted in side by side relation with the second extensions in alignment between the butt ends of the chords. Only the thin metal second extensions separate the butt ends of the chords and provide a bearing surface for the large compressive forces exerted by the butt ends of the chords against one another.

A unique feature of the ridge connectors of the present invention is the fact that they ca be cut from an elongated strip of sheet metal by a progressive die, quickly efficiently and with a minimum loss of metal. Referring to FIGS. 5 through 10, the configuration and construction of ridge connector 64 may be seen. The common edges 111 and 112 of the second and third extensions 97 and 102 of a trailing blank are adjacent the side edge of a leading blank which corresponds to edge 113. The common edge 114 of the first side 116 of the first and second legs of a trailing blank is adjacent the corresponding common edge 117 of the second side 118 of the first and second legs of a corresponding leading blank. The common edges 111 and 112 of the second and third extensions and positioned in inset relation to the common edge 114 of the first side of the first and second legs.

Figure 5:
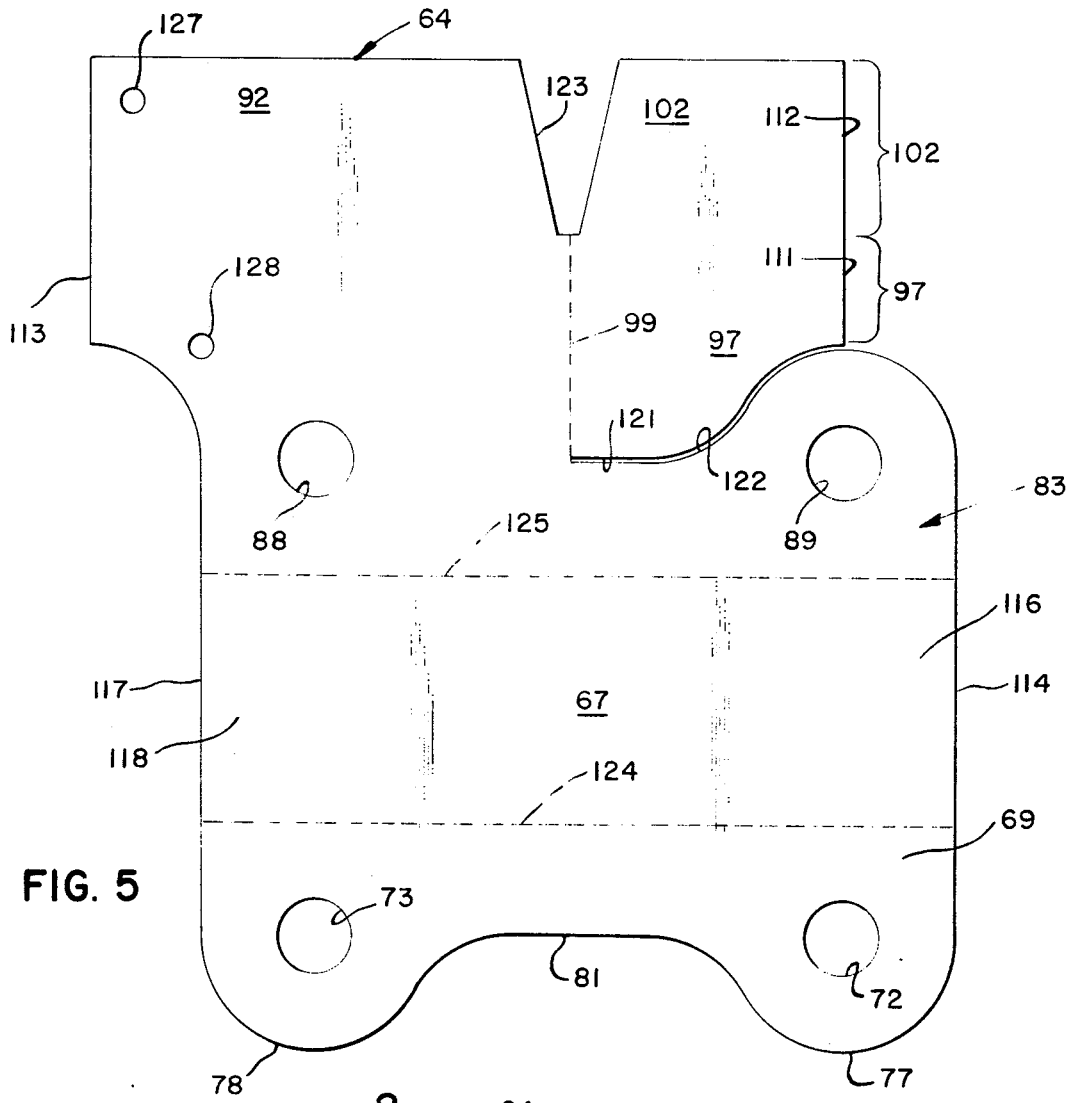
FIG. 5 is a plan view of one of the ridge connectors of the present invention in the unfolded mode.
Figure 6:
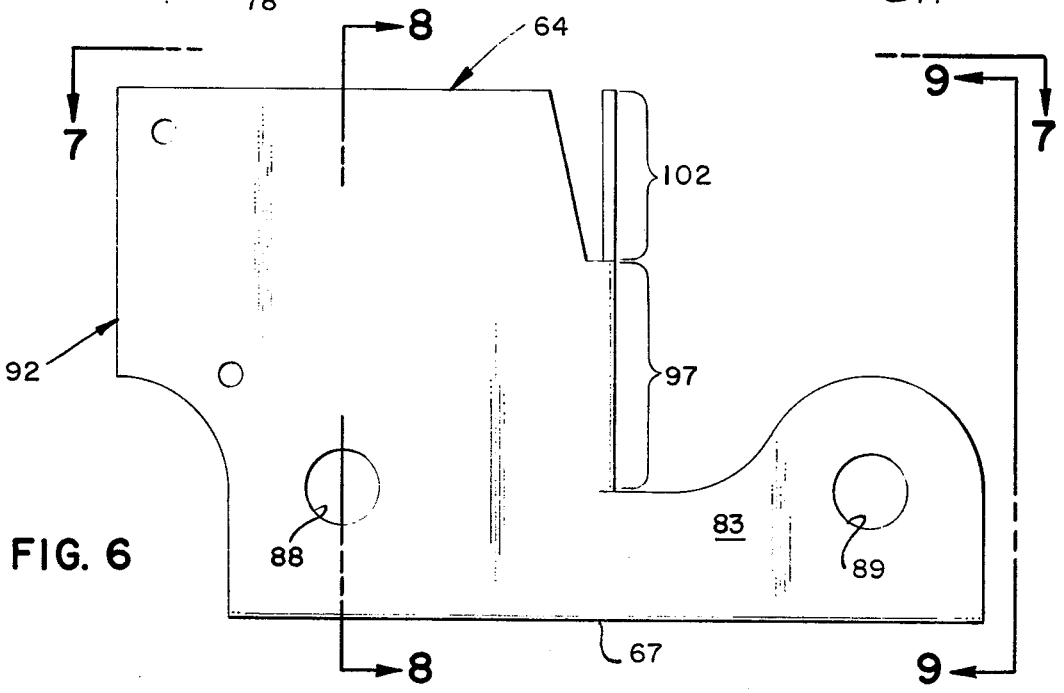
FIG. 6 is a side view of the connector shown in FIG. 5 in the folded mode.
Figure 7:
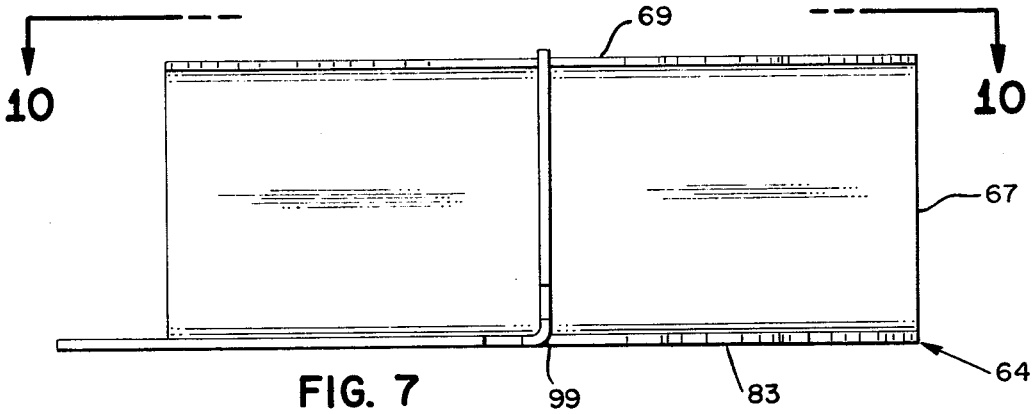
FIG. 7 is a top plan view of the connector shown in FIG. 6.
Figure 8:
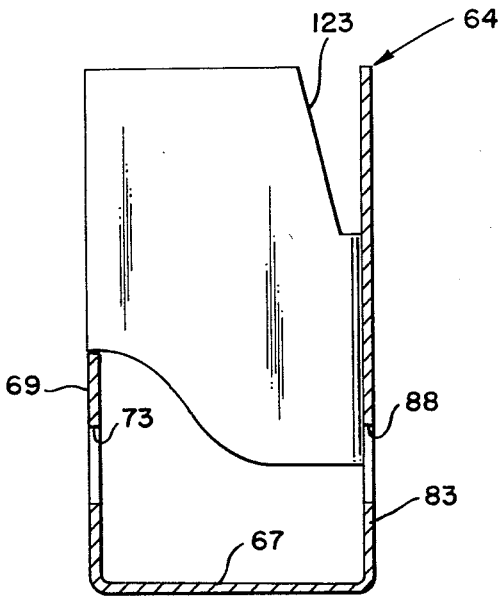
FIG. 8 is a cross sectional view of the connector taken along line 8—8 of FIG. 6.
Figure 9:
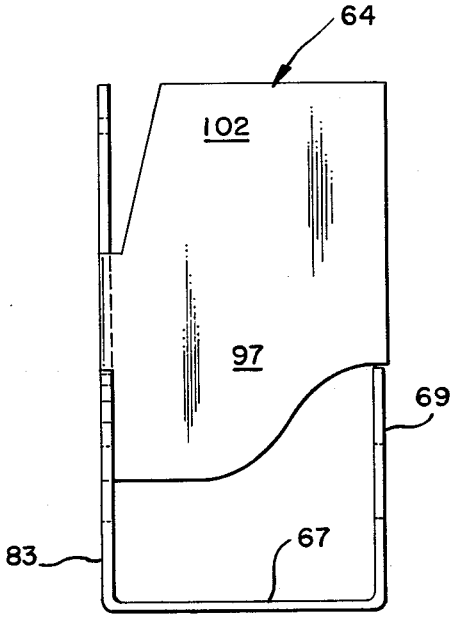
FIG. 9 is a side view of the connector of FIG. 6 taken along line 9—9.
Figure 10:
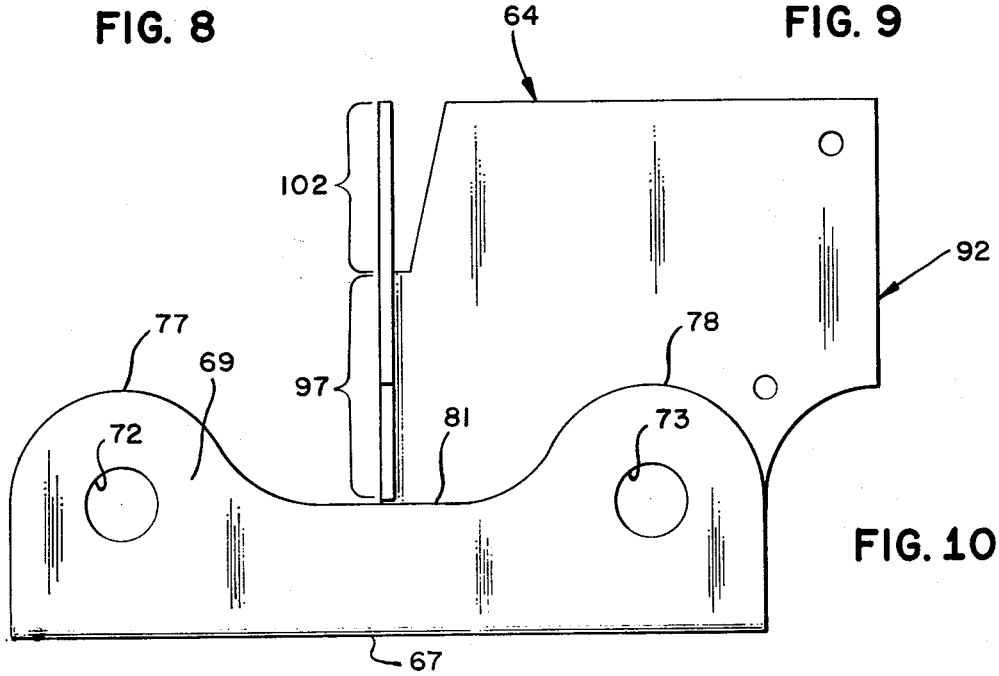
FIG. 10 is a side view of the connector of FIG. 7 taken along line 10—10.

As shown in FIG. 5, the U-shaped ridge connectors are formed from a sheet metal blank in which the bottom edge 121 of the second extension is formed adjacent the upper edge 122 of a portion of the second leg. Edges 121 and 122 are formed in compound curves. The second and third extensions bend along bend line 99 at the base of notch 123. As shown in FIG. 5, the first leg bends along bend line 124 and the second leg bends along line 125. Nail openings 127 and 128 are formed in the first extension.

A unique feature of the present invention is the fact that the slope of the top chords 2 and 3 may vary to meet the design criteria and the same ridge connectors may be used. The connectors may be field modified to accommodate trusses of different pitches. For example, after the grip-groove connectors are installed, ridge connectors 63 and 64 are installed at the butt ends of the two chords 3 and 5. The second extension members 96 and 97 are bent along lines 98 and 99 so that the second extensions are 90° transverse of a level line of the truss. The first extensions 91 and 92 are then bent along lines 93 and 94 so that the extensions are flat against and parallel to their respective chords. Obviously, the angle of bend lines 93 and 94 will change with the changing pitch of different trusses. In like manner, third extensions 101 and 102 will change angles with a change in the pitch of the top chord members.

Thicknesses and grades of materials may change with different design requirements. As an example, the ridge connectors may be made from sixteen gauge galvanized commercial grade steel. The bolts may be No. 5, ½ inch machine bolts.

It is not necessary to the practice of this invention to space the web connection points as shown in FIG. 5. One or more flat gusset plates connected to the grip-groove connectors and ridge connectors could be used and extend downwardly from the top chord to a single connection point for the two intersecting web members.

I claim:

1. A ridge connector for light trusses having abutting wood top chords and metal webs having openings therein comprising:

a. each of said chords is formed with a transverse semi-circular groove across its inside face adjacent its abutting end and slots joining said inner and outer faces at the approximate center lines of said chords, b. a pair of U-shaped grip-groove connectors formed with legs and mounted on said ends of said chords with one leg extending through said chord slot and one leg engaging the side of said chord and each grip-groove connector having an opening adjacent the end of each of said connector legs;

c. a pair of U-shaped ridge connectors connecting the abutting ends of said chords and each including:
1. an elongated base.
2. a first leg formed with a pair of openings spaced from one another and adapted for insertion into said slots.
3. a second leg formed with a pair of openings positioned in alignment with said openings in said first leg.
4. said second leg has a first extension adapted for engaging the edge and a portion of the outer face of said chord, a second extension adapted for engaging the butt ends of said chords, and a third extension connected to said second extension adapted for engaging a portion of the outer face of one of said chords.

d. a pair of pins inserted through the openings in said grip-groove connectors and said U-shaped ridge connectors and adapted for engaging said semi-circular grooves in said chords and said openings in said webs; and e. said U-shaped ridge connectors are mounted in side by side relation with said second extensions in alignment between the butt ends of said chords.

2. A ridge connector as described in claim 1 comprising:

a. said U-shaped ridge connectors are positioned on said abutting ends with said first legs of each U-shaped ridge connector in side by side relation.

3. A ridge connector as described in claim 1 comprising:

a. said U-shaped ridge connectors are formed from a sheet metal blank on a progressive die wherein;
1. the common edges of said second and third extensions of a trailing blank are adjacent the side edge of said first extension of a leading blank;
2. the common edge of a first side of said first and second legs of a trailing blank is adjacent the common edge of the second side of said first and second legs of a leading blank; and
3. said common edge of said second and third extensions is positioned in inset relation to said common edge of said first side of said first and second legs.

4. A ridge connector as described in claim 2 comprising:

a. said U-shaped ridge connectors are formed from a sheet metal blank wherein the bottom edge (121) of said second extension isformed adjacent the upper edge (122) of a portion of said second leg.

5. A ridge connector as described in claim 3 comprising:

a. said bottom edge (121) of said second extension is formed in a compound curve.

* * * * *

UNITED STATES PATENT AND TRADEMARK OFFICE

CERTIFICATE OF CORRECTION

PATENT NO. : 4,050,210
DATED : Sept. 27, 1977
INVENTOR(S) : TYRELL T. GILB

It is certified that error appears in the above-identified patent and that said Letters Patent are hereby corrected as shown below:

In Column 3, line 47, change "bend" to --- bent ---

In Column 3, line 67, change "ca" to --- can ---

In Column 6, line 19, change "claim 2" to --- claim 3 ---

In Column 6, line 25, change "claim 3" to --- claim 4 ---

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*